US005293306A

United States Patent [19]

Bamber

[11] Patent Number: 5,293,306

[45] Date of Patent: Mar. 8, 1994

[54] LANTERN WITH SLIDABLE SHUTTER

[75] Inventor: David J. Bamber, Wichita, Kans.

[73] Assignee: The Coleman Company, Inc., Wichita, Kans.

[21] Appl. No.: 986,922

[22] Filed: Dec. 8, 1992

[51] Int. Cl.[5] ..... F21L 7/00

[52] U.S. Cl. ..... 362/186; 362/280; 362/321; 362/341

[58] Field of Search ..... 362/157, 166, 167, 173, 362/174, 176, 186, 280, 319, 321, 352, 351, 341

[56] References Cited

U.S. PATENT DOCUMENTS

| | | | |
|---|---|---|---|
| 260,933 | 3/1882 | Brassill | 362/167 |
| 941,803 | 11/1909 | McIntyre | 362/167 |
| 1,103,546 | 7/1914 | Spear | 362/166 |
| 1,606,152 | 11/1926 | Douglas | 362/321 |
| 2,309,104 | 1/1943 | Dircksen | 362/277 |
| 2,349,042 | 5/1944 | Holmes | 362/321 |
| 2,482,543 | 9/1949 | Jackson | 362/347 |
| 2,700,100 | 1/1955 | Wissinger | 362/320 |
| 2,785,293 | 3/1957 | Smith et al. | 362/319 |
| 3,016,454 | 1/1962 | Simms | 362/321 |
| 3,629,793 | 12/1971 | Ettischer et al. | 362/157 |
| 4,074,123 | 2/1978 | Wissinger | 362/319 |
| 4,323,955 | 4/1982 | Mark | 362/280 |
| 4,626,972 | 12/1986 | Wolf | 362/351 |
| 4,652,980 | 3/1987 | Segan | 362/157 |
| 4,663,697 | 5/1987 | Stearns | 362/184 |
| 4,725,934 | 2/1988 | Gordin | 362/298 |
| 5,152,601 | 10/1992 | Ferng | 362/186 |

*Primary Examiner*—Richard R. Cole
*Assistant Examiner*—Alan B. Cariaso

[57] ABSTRACT

A lantern having a base, a globe, and a top is provided with a slidable shutter which is movable between an open position in which light can shine through the globe throughout 360° and a closed position in which the shutter blocks light from shining through a portion of the globe. The globe has a generally rectangular transverse cross section provided by a pair of generally flat front and back surfaces and a pair of generally flat side surfaces. The shutter is slidable within a pair of tracks which are provided by ribs which extend along the sides of the back surface. The shutter is releasably latched in the closed position by a pushbutton latch on the top of the lantern.

12 Claims, 2 Drawing Sheets

LANTERN WITH SLIDABLE SHUTTER

BACKGROUND

This invention relates to lanterns of the type which include a light source and a transparent globe which surrounds the light source. More particularly, the invention relates to a lantern which includes a shutter which is slidable between an open position in which light can shine through the entire globe and a closed position in which the shutter blocks light from shining through a portion of the globe.

Lanterns generally provide illumination in a fixed direction. Most lanterns provide illumination throughout a full 360° around the lantern. Other lanterns may illuminate throughout an arc of less than 360°.

One specific prior art lantern includes a pair of fluorescent tubes within a globe. An arcuate or generally half-moon-shaped reflector is movably mounted adjacent each fluorescent tube. The reflectors are movable between first positions in which the reflectors reflect light away from each other to provide illumination throughout an arc of less than 360° and a second position in which the reflectors provide illumination throughout about 180°.

SUMMARY OF THE INVENTION

The invention provides a lantern with a shutter which is slidably mounted on the globe. When the shutter is open, the lantern provides illumination throughout a full 360°. When the shutter is closed, the shutter blocks illumination through a portion of the globe and reflects light through the opposite portion of the globe. The shutter is slidably mounted within a pair of tracks on the globe. The shutter is releasably latched in the closed position by a pushbutton latch on the top of the lantern.

DESCRIPTION OF THE DRAWINGS

The invention will be explained in conjunction with an illustrative embodiment shown in the accompanying drawing, in which.

DESCRIPTION OF SPECIFIC EMBODIMENT

Figure 1:
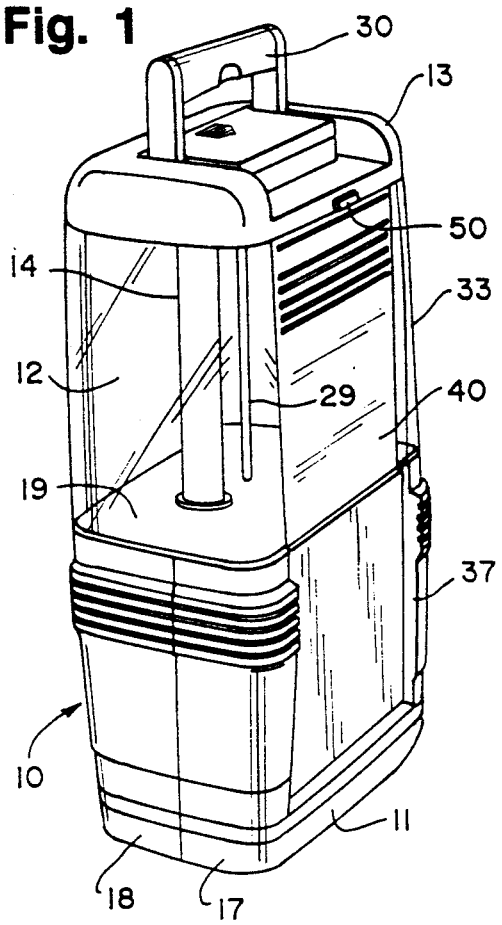
FIG. 1 is a perspective view of a lantern formed in accordance with the invention with the shutter in the closed position.

The numeral 10 designates generally a lantern having a base 11, a globe 12, and a top 13. The particular lantern illustrated is an electric lantern which includes a pair of fluorescent tubes 14 and 15 as a light source. It will be understood, however, that the invention can be used with other types of lanterns. For example, the lantern can burn liquid or propane fuel and use an incandescent mantle as a light source.

The fluorescent lantern 10 is similar to the lantern which is described in U.S. Pat. No. 4,663,697. Details of the structure of the lanterns and the manner of mounting and connecting the fluorescent tubes are described in the patent.

The base 11 includes a bottom wall 16, a pair of U-shaped side walls 17 and 18, and a top wall 19. The walls enclose a battery housing for a pair of 6 volt dry cell batteries.

The globe 12 is molded from transparent plastic and is generally rectangular in transverse cross section. The globe includes generally flat front and back walls 22 and 23 (FIG. 4) and a pair of generally flat side walls 24 and 25. The bottom edge of the globe is retained within a groove in the top wall of the base.

The top 13 is mounted on the top edge of the globe. The top includes a bottom wall 27 and an upper casing 28 which is secured to the bottom wall by screws. The bottom wall includes a groove for holding the top edge of the globe. The base, globe, and top are held together by a rod 29 which extends through openings in the bottom wall 27 of the top and the top wall 19 of the base. The ends of the rod are threaded, and nuts are screwed onto the threaded ends to clamp the top and bottom against the globe. A handle 30 is pivotally mounted on the top and is movable between a carrying position illustrated in FIG. 1 and a storage position illustrated in FIG. 2.

Figures 4, 5:
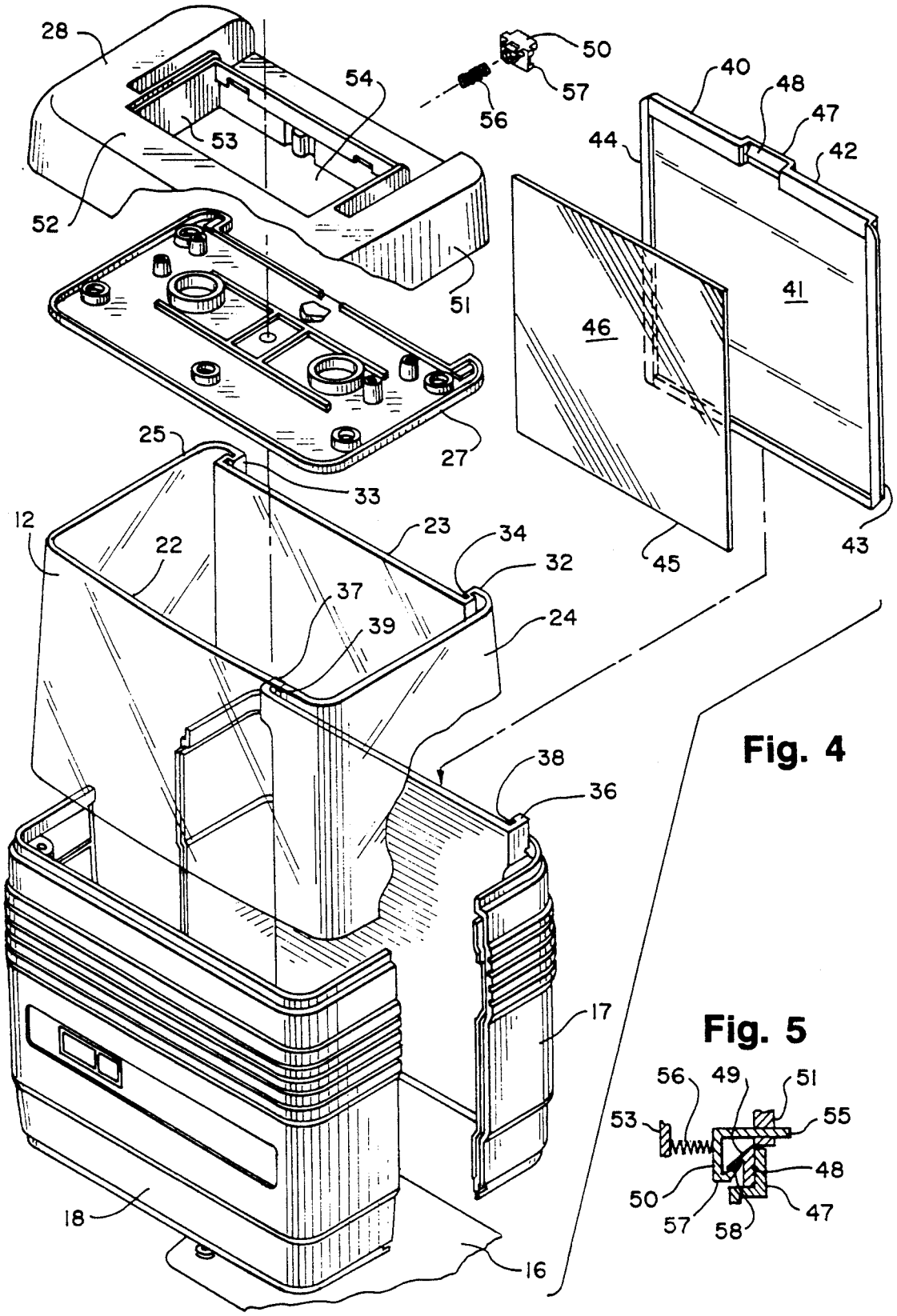
FIG. 4 is an exploded perspective view of the lantern.
FIG. 5 is a fragmentary sectional view through the latches on the shutter and the top of the lantern.

Referring to FIG. 4, the back wall 23 of the globe includes a pair of laterally inwardly extending ribs 32 and 33 (FIG. 4) which are spaced outwardly from the flat surface of the back wall to provide a pair of grooves or tracks 34 and 35. The wall portion 17 of the base includes similar ribs 36 and 37 which provide tracks 38 and 39 which are aligned with the tracks 34 and 35.

A rectangular shutter 40 is slidably retained within the tracks 34, 35, 38, and 39. The shutter includes a flat wall 41, a perimetric rib 42, and a pair of side flanges 43 and 44 which fit into the tracks. A panel 45 which has a reflective surface 46 is secured within the rib 42. The shutter is advantageously molded from plastic, and the reflector 45 may be metal.

The top edge of the shutter includes an outwardly projecting latching portion 47. The latching portion includes a latch 48 (see also FIG. 5) which has an angled upper camming surface 49.

A pushbutton latch 50 is mounted in the top casing 28 for movement toward and away from the shutter. The top casing is generally U-shaped in cross section and includes an outer wall 51, a top wall 52, and an inner wall 53 which defines a central opening 54. The pushbutton latch 50 includes a finger portion 55 which extends through an opening in the outer wall of the casing (see also FIGS. 1 and 2). A compression spring 56 is positioned between the inner wall 53 and the pushbutton and resiliently biases the pushbutton outwardly into a latching position illustrated in FIG. 5. An upwardly angled latch portion 57 on the pushbutton is engageable with the latch 48 and includes a bottom camming surface 58.

Figure 2:
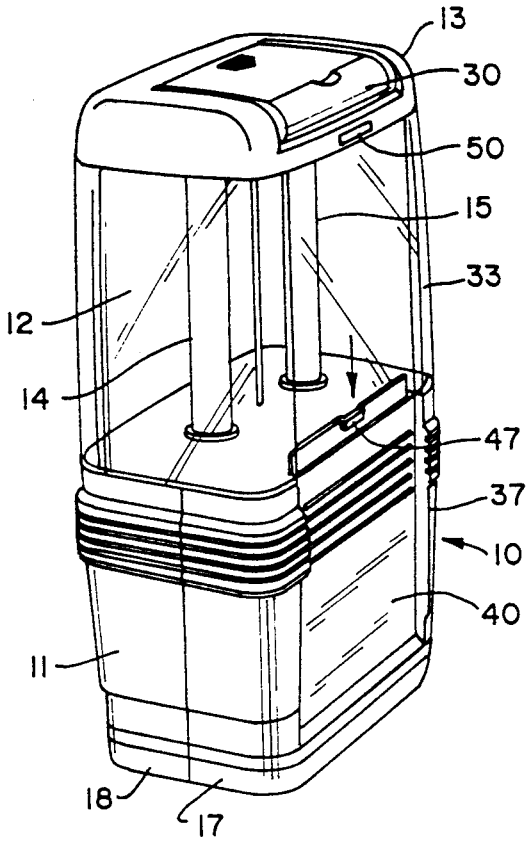
FIG. 2 is a view similar to FIG. 1 showing the shutter in the open position.

FIG. 2 illustrates the shutter 40 in its open or down position. The shutter is retained within the tracks 38 and 39 in the base, and the globe 12 is completely exposed. Light from the fluorescent tubes 14 and 15 can shine through the globe throughout a full 360°.

Figure 3:
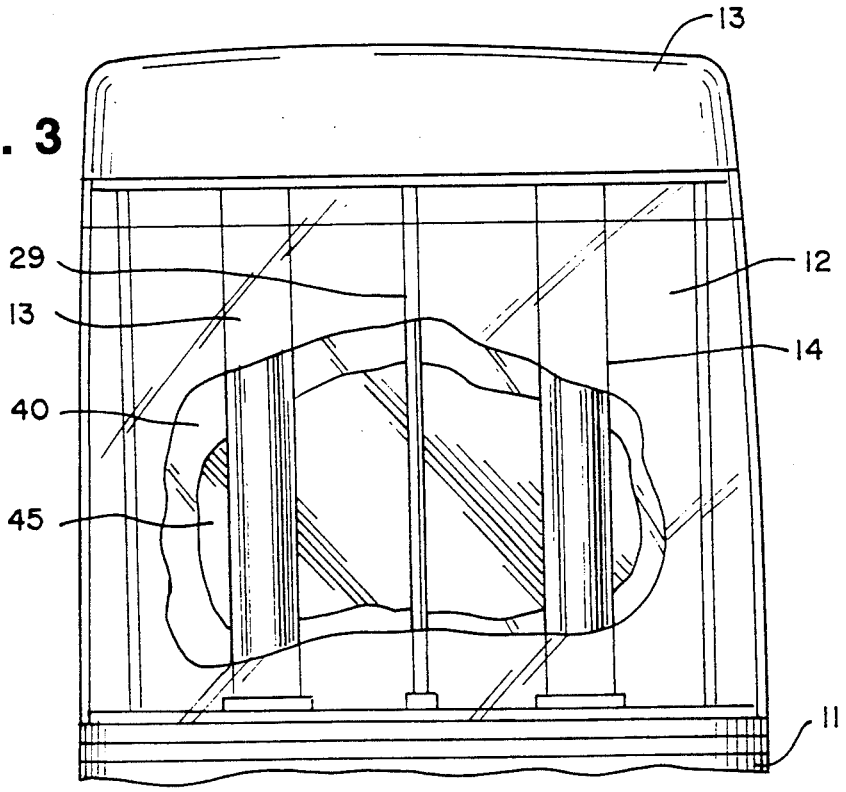
FIG. 3 is a fragmentary front elevational view of the lantern with the shutter in the closed position.

FIG. 3 illustrates the shutter in the closed or up position. The shutter blocks light from passing through the back wall 23 of the globe, and the reflector 45 in the shutter reflects light through the front wall 22 of the globe, thereby increasing the amount of the light which shines from the front of the lantern.

As the shutter slides upwardly in the tracks 34 and 35 and 38 and 39 toward the closed position, the camming surfaces 49 and 58 on the latch 48 and pushbutton 50 cam the pushbutton inwardly until the latch 48 moves into the latching position illustrated in FIG. 5. The spring 56 then returns the pushbutton to the latching position. The shutter can be lowered by pushing the finger portion 55 of the pushbutton to release the latches and then sliding the shutter downwardly. If desired, the shutter can be positioned anywhere between the fully open and fully closed positions.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A lantern comprising:

a base, a globe mounted on the base, a light source supported by the vase and positioned inside of the globe, and a top supported by the globe, the improvement comprising the globe being integrally molded from transparent plastic and including a pair of integrally molded tracks which extend between the base and the top, the base including a pair of tracks which are aligned with the tracks in the glove, and a shutter slidably mounted in the tracks on the glove and on the base and being slidable between a closed position on the glove in which the shutter prevents light from the light source from shining through a portion of the globe and an open position on the base in which the shutter does not prevent light from the light source from shining through said portion of the globe.

2. The lantern of claim 1 in which the shutter includes a reflective surface which faces toward the light source when the shutter is in the closed position.

3. The lantern of claim 1 including latch means on the top and on the shutter for releasably latching the shutter in the closed position.

4. The lantern of claim 3 in which the latch means includes a latch on the shutter and a pushbutton slidably mounted on the top for movement between a latched position and an unlatched position, the pushbutton including a latching portion which is engageable with the latch on the shutter when the pushbutton is in the latched position.

5. The lantern of claim 4 including a spring resiliently biasing the pushbutton to the latched position.

6. The lantern of claim 4 including cam surfaces on the latching portion of the pushbutton and on the latch on the shutter whereby the pushbutton is cammed out of the latching portion when the shutter is moved toward the closed position.

7. The lantern of claim 4 in which each of the globe and the base has a generally rectangular transverse cross section which is provided by generally flat front and back surfaces and opposite side surfaces, the tracks on each of the globe and the base being provided along the sides of the back surface thereof, the shutter being generally flat and being slidably retained within the tracks.

8. The lantern of claim 7 in which each of the tracks is formed by a rib which overlaps a portion of the flat portion of the globe.

9. The lantern of claim 7 in which the shutter includes a reflective surface which faces toward the light source when the shutter is in the closed position.

10. The lantern of claim 1 in which each of the globe and the base has a generally rectangular transverse cross section which is provided by generally flat front and back surfaces and opposite side surfaces, the tracks on each of the globe and the base being provided along the sides of the back surface thereof, the shutter being generally flat and being slidably retained within the tracks.

11. The lantern of claim 10 in which the shutter includes a reflective surface which faces toward the light source when the shutter is in the closed position.

12. The lantern of claim 10 in which each of the tracks is formed by a rib which overlaps a portion of the flat portion of the globe.

* * * * *

UNITED STATES PATENT AND TRADEMARK OFFICE

CERTIFICATE OF CORRECTION

PATENT NO. : 5,293,306

DATED : March 8, 1994

INVENTOR(S) : David J. Bamber

It is certified that error appears in the above-indentified patent and that said Letters Patent is hereby corrected as shown below:

Col. 3, line 22 change "vase" to --base-- and in lines 29, 31, and 32 change "glove" to --globe--.

Signed and Sealed this

Nineteenth Day of July, 1994

Bruce Lehman

*Attest:*

BRUCE LEHMAN

*Attesting Officer*

*Commissioner of Patents and Trademarks*